US005167080A

United States Patent [19]

Burkhardt et al.

[11] Patent Number: 5,167,080

[45] Date of Patent: Dec. 1, 1992

[54] METHOD AND APPARATUS FOR DRYING A WEB OF INDETERMINATE LENGTH

[75] Inventors: Robert R. Burkhardt; Bruce M. Reid, both of Rochester, N.Y.

[73] Assignee: Eastman Kodak Company, Rochester, N.Y.

[21] Appl. No.: 789,724

[22] Filed: Nov. 8, 1991

[51] Int. Cl.[5] ..... F26B 13/00

[52] U.S. Cl. ..... 34/82; 34/155

[58] Field of Search ..... 34/82, 85, 155, 156, 34/160; 55/290, 385.1, 385.4

[56] References Cited

U.S. PATENT DOCUMENTS

| | | | |
|---|---|---|---|
| 1,128,510 | 2/1915 | Quist . | |
| 2,889,806 | 6/1959 | Conant | 118/643 |
| 3,136,654 | 6/1964 | Craver | 117/119.8 |
| 3,831,350 | 8/1974 | Gilles et al. | 55/128 |
| 4,213,766 | 7/1980 | Wyatt | 55/2 |
| 4,435,909 | 3/1984 | Williamson, Jr. | 34/82 |
| 4,615,124 | 10/1986 | Gierse et al. | 34/82 |
| 4,749,385 | 6/1988 | Brunner et al. | 55/97 |

*Primary Examiner*—Henry A. Bennet
*Attorney, Agent, or Firm*—Charles E. Snee, III

[57] ABSTRACT

A method and apparatus are disclosed for delivering a flow of clean air to an enclosure (14) in which a web (12) is to be dried, including a fan (18) for generating a flow of contaminated air, a duct (20) for directing the flow of contaminated air into a distribution plenum (22), flow turning vanes (24) and a baffle plate (32) within the plenum for distributing the flow of contaminated air and at least one high-efficiency particulate filter (26) for filtering the contaminated air to produce a flow of clean air which is passed into the enclosure.

12 Claims, 2 Drawing Sheets

METHOD AND APPARATUS FOR DRYING A WEB OF INDETERMINATE LENGTH

TECHNICAL FIELD

The invention concerns methods and apparatus for delivering clean air to be used, for example, for drying objects. More particularly, the invention concerns such methods and apparatus for drying webs of indeterminate length, such as webs of photographic film, using a flow of clean air.

BACKGROUND ART

Numerous industrial applications require the use of a flow of very clean air, such as clean rooms for microelectronics manufacture, various facilities in the nuclear power industry and driers for webs of indeterminate length like freshly coated photographic film. Typically, such clean air is provided by filtering with high efficiency particulate air filters, commonly referred to as HEPA filters, which are throw-away dry type filters having a minimum particle removal efficiency typically not less than 99.97 to 99.99 percent for 0.3 micron particles and a maximum clean flow resistance typically not more than 0.5 to 1.0 inch of water at rated flow capacity. Such filters come in a variety of face dimensions and depths and typically have design flow capacities, at maximum flow resistance, from 25 to 1000 standard cubic feet per minute. In web drier installations familiar to the Applicants, such filters are positioned with the plane of the filter substantially vertical in arrays or banks housed in an enclosure remote from the point at which the clean air is needed. This known arrangement has been considered desirable to facilitate inspection and replacement of the filters. Air to be cleaned is forced through the filters by a suitable fan and the clean air is then brought to the point of use through ducts, which typically are made from stainless steel to minimize potential for contamination of the clean air with oxide particles from the duct walls and the like.

A number of disadvantages result from this known arrangement. The remote filter banks and their enclosures are costly and consume a considerable volume of building space. The ducts between the filters and the point of use must be stainless steel to minimize contamination, which increases the cost of the ducting by as much as 50% compared, for example, to galvannealed steel. In spite of the high efficiency of the HEPA filters, the ducts downstream of them must be cleaned and inspected periodically to remove small amounts of contaminants generated within or aspirated into the ducts. Even when such periodic cleaning is done, particle contamination can still be unacceptably high, leading in the case of a drier to contamination of the web during drying. Where photographic film is being dried, this can require large amounts of expensive product to be discarded due to contamination. Thus, a need has existed for an improved method and apparatus for filtering air in which contamination from the duct work is reduced and which is simpler and less expensive than prior art methods and apparatus.

SUMMARY OF THE INVENTION

An apparatus for delivering a flow of clean air to an enclosure in accordance with the invention comprises means for generating a flow of contaminated air and duct means for directing the flow of contaminated air from the means for generating, the duct means having first flow area. A plenum means for receiving the flow of contaminated air is connected to the duct means, the plenum means having a second flow area larger than the first flow area. Means are mounted within the plenum means for distributing the flow of contaminated air across the second flow area. At least one filter element is supported downstream of the means for distribution by means extended across the second flow area, whereby the flow of contaminated air passes through the filter element. Preferably, the filter element is supported on the upper side of a wall element extended substantially horizontally across the plenum means, there being an opening through the wall element which is closed by the filter element and a frame means for positioning the filter element at the opening. Due to this preferred arrangement, the filter element is held in place within the frame due to gravity and the flow of air, thus eliminating any need for complex fasteners for the filter element. At least one discharge opening is provided from the plenum means to deliver clean air directly into the enclosure. The length of the flow path between filter element and the discharge opening can be very short in accordance with the invention (on the order of inches), thus minimizing the amount of stainless steel to be used downstream of the filter. When the enclosure comprises a drier for a web of indeterminate length, means are provided for moving the web through the enclosure so that the flow of clean air contacts and dries the web. Means may be provided across the discharge opening into the enclosure for distributing the flow of clean air across the width of the web. To reduce turbulence at the inlet side of the filter element, a perforated baffle plate may be mounted within the plenum means between the means for distributing contaminated air and the filter element. The method of the invention comprises the steps of the mode of operation of the apparatus just described.

BRIEF DESCRIPTION OF THE DRAWINGS

The foregoing and other objectives, features and advantages of the invention will be apparent from the following more particular description of the preferred embodiment of the invention, as illustrated in the accompanying drawings.

DESCRIPTION OF THE PREFERRED EMBODIMENTS

Figure 1:
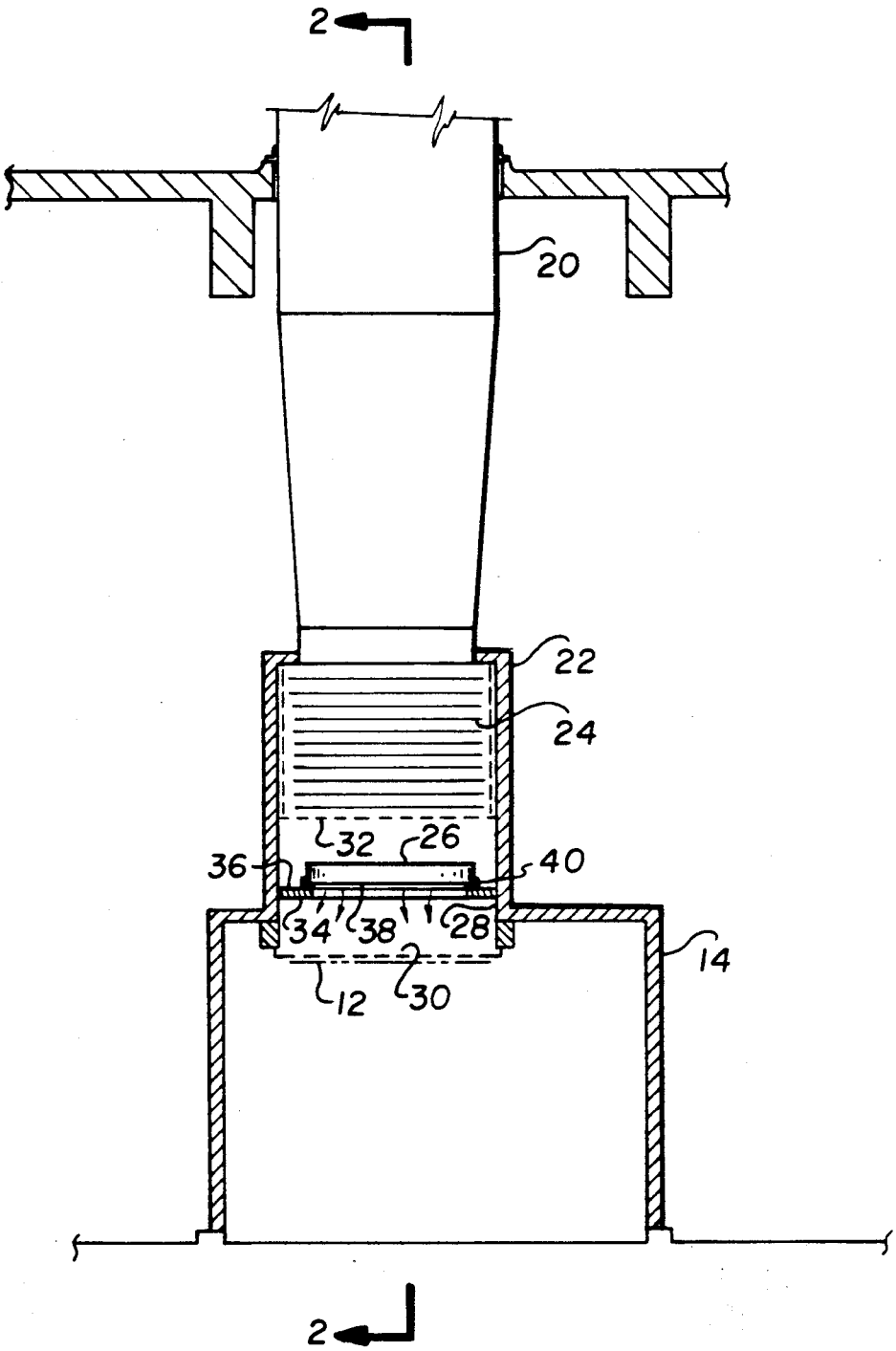
FIG. 1 shows an elevation view, partly in section, of an apparatus according to the invention.

The following is a detailed description of the preferred embodiment of the invention, reference being made to the drawings in which the same reference numerals identify the same elements of structure in each of the Figures.

Figure 2:
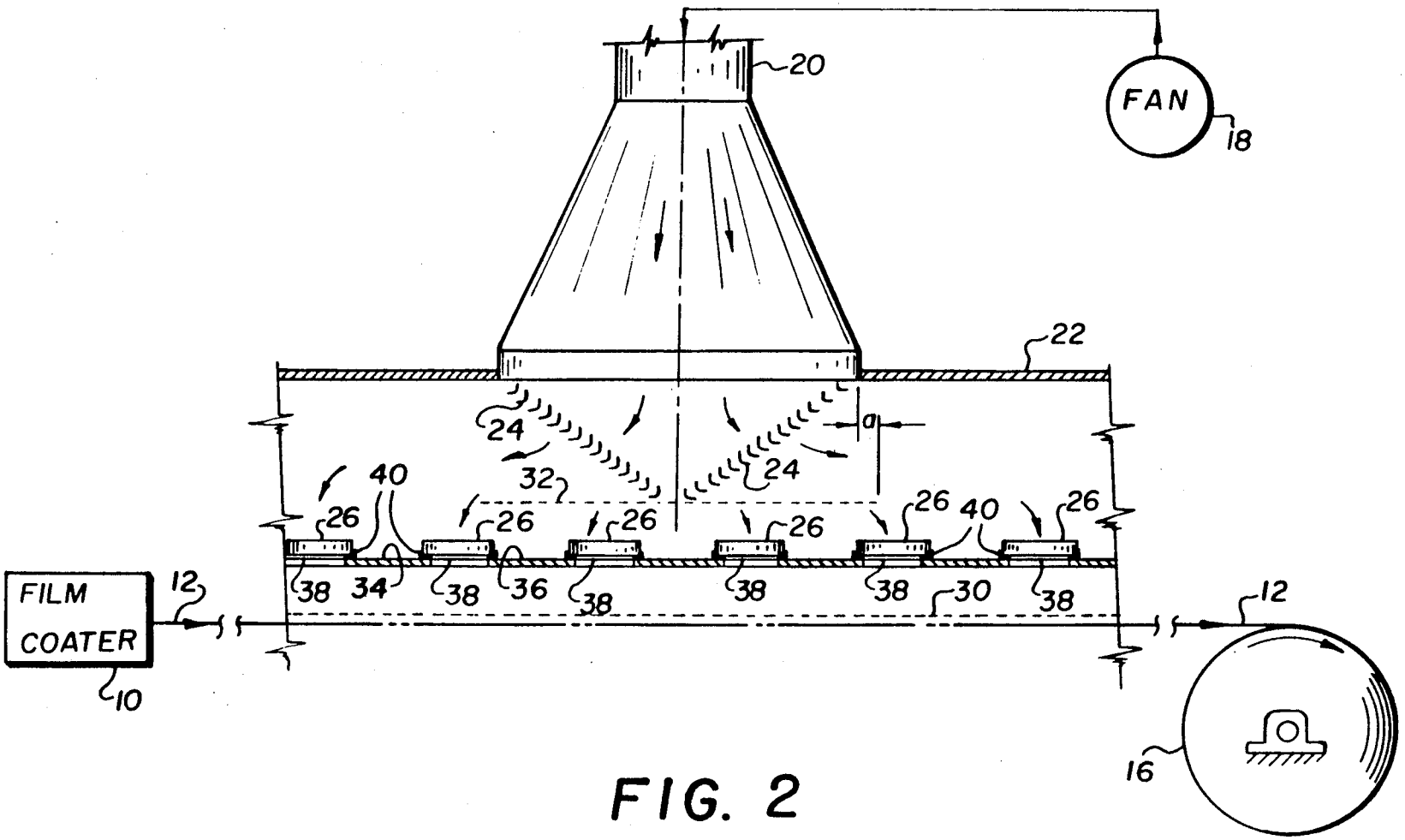
FIG. 2 shows a section view taken along line 2—2 of FIG. 1.

FIGS. 1 and 2 illustrate an embodiment of our invention for delivering clean air to a drier for a web of indeterminate length, such as a freshly coated web of photographic film. However, those skilled in the art will understand that the invention may be used to deliver clean air to any sort of enclosure. In the illustrated embodiment, a conventional film coater 10 applies photographic materials to a support base to produce a web 12 which may be thousands of feet in length. As it leaves coater 10, web 12 requires drying before being wound; so, it is moved through an enclosure 14 within which a flow of clean air is passed into contact with the web to dry it. After drying, web 12 is wound onto a take up roll 16 which is rotated by a suitable motor, not illustrated.

A flow of air for drying web 12 is generated by means such as a fan 18, whose output is directed into a duct means 20 having a first flow area. At this point, the air is contaminated; that is, it contains particles in too great a quantity to be suitable for drying web 12. Duct 20 directs the flow of contaminated air, preferably but not necessarily downwardly, into the center portion of a distribution plenum means 22 having a second flow area greater than that of duct 20, which produces a reduction in the velocity of the contaminated air moving through plenum 22. In one actual embodiment of the invention, the velocity of the contaminated air was reduced by approximately 50% after entry into plenum 22. Positioned within plenum 22 just downstream of the outlet of duct 20 are a plurality of flow turning vanes 24 which preferably are arranged in a V-shaped configuration with the apex of the V-shape essentially on the centerline of duct means 20 and the V-shape opening in the upstream direction. Vanes 24 extend essentially across the width of plenum 22 and are configured to direct the flow of contaminated air laterally toward the opposite ends of plenum 22 to distribute the flow of air relatively evenly to a plurality of underlying filters. Beneath vanes 22 are located one or more HEPA filter elements 26, the number and exact type of filter elements, as will be understood by those skilled in the art, being functions of the desired flow rate of air, the type of contaminants to be removed, the width and length of plenum 22 and the like. Beneath filter elements 26, a discharge opening 28 from plenum 22 passes the clean flow of air from plenum 22 through a screen 30 which distributes the flow of clean air substantially across the width and length of enclosure 14. To promote a relatively even distribution of contaminated air through filter elements 26, screen 30 should have a pressure drop substantially greater than that of filter elements 26, preferably at least five times larger than that of the clean pressure drop of filter elements 26.

To reduce turbulence in the contaminated air reaching filter elements 26 and to aid in distributing the contaminated air to the filters, an essentially horizontal perforated baffle plate 32 may be mounted between the walls of plenum 22 between vanes 24 and filter elements 26. For greatest effectiveness, baffle plate 32 should be centered essentially on the centerline of duct 20 several inches above filter elements 26 and should extend a distance a of a few inches beyond the widest portion of the flow area of duct 20 where duct 20 empties into plenum 22. In one embodiment of the invention, the distance of plate 32 above filter elements 26 was approximately 15 inches, and the distance a was approximately 6 inches. In that embodiment, the flow velocity through duct 20 was approximately 1500 to 2000 feet per minute and filters 26 were conventional HEPA filters, such as Model No. 12CMP manufactured by Cambridge Filter Corporation. Rather than being oriented vertically as typically is done in banks of such filters, filter elements 26 are supported by an essentially horizontal wall member 34 which extends across the width and breadth of plenum 22 and has an upper side 36. Each filter element 26 is positioned above a filter opening 38 through wall member 34 and is held against lateral movement by a surrounding frame means 40, which may comprise a simple frame of angle irons. To prevent leakage around filter elements 26, each filter preferably sits upon a gasket within frame means 40 and caulking is provided between each filter element and its frame. Due to this arrangement, filter elements 26 also are held within their frames 40 due to gravity and the flow of contaminated air impinging upon them. Thus, complex fasteners are not required to secure filter elements 26, which can be relatively easily removed for replacement or maintenance.

By incorporating filter elements 26 and their support structures into air distributing plenum 22, the filters can be located only a matter of inches above distributor screen 30 through which clean air passes into enclosure 14 to dry web 12. Thus, only the portion of plenum 22 from filters 26 to screen 30 need be made of stainless steel to minimize contamination of the filtered air. In one actual installation of the invention, duct 20 was approximately one hundred feet in length and was made from galvannealed steel in stead of stainless steel; whereas, the portion of plenum 22 from filters 26 to screen 30 was only approximately 15 inches in length and was made from stainless steel. This reduction in the amount of stainless steel for the air delivery system resulted in a savings of many hundreds of thousands of dollars.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. Apparatus for drying a web of indeterminate length with a flow of clean air, comprising:

an enclosure;

means for moving a web to be dried through said enclosure;

means for generating a flow of contaminated air;

duct means for directing said flow of contaminated air from said means for generating, said duct means having first flow area;

plenum means connected to said duct means for receiving said flow of contaminated air, said plenum means having a second flow area larger than said first flow area;

means mounted within said plenum means for distributing said flow of contaminated air across said second flow area;

at least one filter element;

means extended across said second flow area for supporting said filter element downstream of said means for distributing, whereby said flow of contaminated air passes through said filter element to become a flow of clean air; and at least one discharge opening from said plenum means into said enclosure for passing said flow of clean air into contact with said web.

2. Apparatus according to claim 1, further comprising means extended across said discharge opening for distributing said flow of clean air across the width of said web.

3. Apparatus according to claim 1, wherein said first flow area has a centerline, further comprising a perforated baffle plate between said means for distributing and said filter element, said baffle plate being centered essentially on said center line of and extended beyond said first flow area.

4. Apparatus according to claim 1, wherein said means for supporting comprises a wall member extended substantially horizontally across said plenum means, said wall member having an upper side, at least one filter opening through said wall member, and frame means positioned at said filter opening on said upper side for positioning said filter element to close said filter opening, whereby said filter element is retained within said frame means by gravity and said flow of contaminated air.

5. A method for drying a web of indeterminate length with a flow of clean air, comprising the steps of:

providing an enclosure;

moving a web to be dried through said enclosure;

generating a flow of contaminated air;

providing a duct having a first flow area;

directing said flow of contaminated air through said duct;

providing a plenum having a second flow area greater than said first flow area;

directing said flow of contaminated air from said duct into said plenum;

distributing said flow of contaminated air across said second flow area;

providing at least one filter element;

supporting said filter element within said plenum to receive said flow of contaminated air after said distributing;

passing said flow of contaminated air through said filter element to produce a flow of clean air; and thereafter passing said flow of clean air from said plenum, into said enclosure and into contact with said web.

6. A method according to claim 5, wherein said first flow area has a center line, further comprising the steps of:

providing a perforated baffle plate, said baffle plate having an area larger than said first flow area;

positioning said baffle plate essentially on said center line and extended beyond said first flow area; and passing at least a portion of said flow of contaminated air through said baffle plate after said distributing and before passing through said filter element.

7. Apparatus for delivering a flow of clean air to an enclosure, comprising:

means for generating a flow of contaminated air;

duct means for directing said flow of contaminated air from said means for generating, said duct means having first flow area;

plenum means connected to said duct means for receiving said flow of contaminated air, said plenum means having a second flow area larger than said first flow area;

means mounted within said plenum means for distributing said flow of contaminated air across said second flow area;

at least one filter element;

means extended across said second flow area for supporting said filter element downstream of said means for distributing, whereby said flow of contaminated air passes through said filter element to become a flow of clean air; and at least one discharge opening from said plenum means for passing said flow of clean air into said enclosure.

8. Apparatus according to claim 7, further comprising means extended across said discharge opening for distributing said flow of clean air into said enclosure.

9. Apparatus according to claim 7, wherein said first flow area has a centerline, further comprising a perforated baffle plate between said means for distributing and said filter element, said baffle plate being centered essentially on said center line of and extended beyond said first flow area.

10. Apparatus according to claim 7, wherein said means for supporting comprises a wall member extended substantially horizontally across said plenum means, said wall member having an upper side, at least one filter opening through said wall member, and frame means positioned at said filter opening on said upper side for positioning said filter element to close said filter opening, whereby said filter element is retained within said frame means by gravity and said flow of contaminated air.

11. A method for delivering a flow of clean air to an enclosure, comprising the steps of:

generating a flow of contaminated air;

providing a duct having a first flow area;

directing said flow of contaminated air through said duct;

providing a plenum having a second flow area greater than said first flow area;

directing said flow of contaminated air from said duct into said plenum;

distributing said flow of contaminated air across said second flow area;

providing at least one filter element;

supporting said filter element within said plenum to receive said flow of contaminated air after said distributing;

passing said flow of contaminated air through said filter element to produce a flow of clean air; and thereafter passing said flow of clean air from said plenum into said enclosure.

12. A method according to claim 11, wherein said first flow area has a center line, further comprising the steps of:

providing a perforated baffle plate, said baffle plate having an area larger than said first flow area;

positioning said baffle plate essentially on said center line and extended beyond said first flow area; and passing at least a portion of said flow of contaminated air through said baffle plate after said distributing and before passing through said filter element.

* * * * *